US010513411B2

(12) United States Patent
Yu Chen

(10) Patent No.: US 10,513,411 B2
(45) Date of Patent: Dec. 24, 2019

(54) STRAP DISPENSER HAVING A HANGING STRUCTURE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 79 days.

(21) Appl. No.: 15/924,295

(22) Filed: Mar. 19, 2018

(65) Prior Publication Data

US 2019/0284015 A1 Sep. 19, 2019

(51) Int. Cl.

| | |
|---|---|
| ***B65H 75/30*** | (2006.01) |
| ***B65H 75/40*** | (2006.01) |
| ***B65B 13/18*** | (2006.01) |
| ***B65H 75/44*** | (2006.01) |

(52) U.S. Cl.

CPC ..... *B65H 75/403* (2013.01); *B65B 13/185* (2013.01); *B65H 75/30* (2013.01); *B65H 75/4428* (2013.01)

(58) Field of Classification Search

CPC .. B65H 75/30; B65H 75/403; B65H 75/4428; B65B 13/185

See application file for complete search history.

(56) References Cited

U.S. PATENT DOCUMENTS 3,831,877 A * 8/1974 Bennett ..... B65H 49/32 242/594.3
7,328,776 B2 * 2/2008 Yu Chen ..... B65H 49/32 188/139
2006/0032967 A1 * 2/2006 Yu Chen ..... B65H 49/305 242/588
2006/0214070 A1 * 9/2006 Yu Chen ..... B65B 13/185 248/80
2008/0100013 A1 * 5/2008 Yu Chen ..... B65H 75/403 280/47.34
2009/0071771 A1 * 3/2009 Yu Chen ..... F16D 51/00 188/74
2014/0263526 A1 * 9/2014 Yu Chen ..... B26D 1/185 225/39
2015/0054240 A1 * 2/2015 Yu Chen ..... B62B 3/10 280/47.11
2015/0197361 A1 * 7/2015 Yu Chen ..... B65B 61/06 225/47
2017/0203937 A1 * 7/2017 Yu Chen ..... B65H 59/16

* cited by examiner

*Primary Examiner* — Sang K Kim
(74) *Attorney, Agent, or Firm* — Bruce Stone LLP; Joseph Bruce

(57) ABSTRACT

A strap dispenser having a hanging structure is disclosed. The strap dispenser includes a base. The base includes a fixing plate. The fixing plate is provided with a strap reel rack. The strap reel rack is provided with a strap reel for placing a strapping roll. The base is connected with a hanging unit. The hanging unit is provided with a plurality of hanging members. When the user wants to use the strap dispenser, the hanging members may be hung with an air tube and a pneumatic/electrical tool. The strap reel is rotated with the movement of a strapping roll. The hanging tool can be used to assist the baling operation.

10 Claims, 7 Drawing Sheets

STRAP DISPENSER HAVING A HANGING STRUCTURE

FIELD OF THE INVENTION

The present invention relates to a strap dispenser, and more particularly to a strap dispenser having a hanging structure.

BACKGROUND OF THE INVENTION

A strap dispenser is used as an auxiliary tool for a strapping roll so that the strapping roll can be used more easily and efficiently. A conventional strap dispenser has a frame. The frame is provided with a shaft. The shaft is inserted through a strap reel. The strap reel has an inner disk and an outer disk. The strapping roll is mounted to the strap disk and located between the inner disk and the outer disk. The frame is provided with two wheels. When in use, the strap is continuously pulled out from the strap reel. The strap dispenser can be moved through the wheels.

Although the above-mentioned strap dispenser has the advantages of a simple structure, convenient operation and good mobility, in the long-term use and research of the strap dispensers, the inventor of this application finds that after an object is baled with the strap, it is often necessary to use a pneumatic/electric tool to tighten the strap and further use a cutting tool to cut the excess strap so as to complete the baling. Therefore, in the baling process, it is necessary to prepare the strap dispenser and the pneumatic/electric tool, resulting in inconvenience in carrying. Accordingly, the inventor of the present invention has devoted himself based on his many years of practical experiences to solve these problems.

SUMMARY OF THE INVENTION

The primary object of the present invention is to provide a strap dispenser having a hanging structure for hanging a pneumatic/electrical tool, making the baling operation more convenient and effortless.

In order to achieve the aforesaid object, the strap dispenser of the present invention comprises a base, a moving unit, and a hanging unit. The base includes a wheel shaft and a fixing plate. The fixing plate is provided with a strap reel rack. A shaft is insertedly connected to the strap reel rack. The shaft is pivotally connected with a strap reel. The strap reel has a first disk and a second disk parallel to the first disk. The moving unit includes at least one moving wheel and two fixed wheels. The moving wheel is mounted to the base. The fixed wheels are mounted to two ends of the wheel shaft, respectively. The hanging unit includes a first rack body. One end of the first rack body is connected to the base. Another end of the first rack body is connected with a second rack body. The first rack body and the second rack body are provided with a plurality of hanging members.

Through the strap dispenser of the present invention, the user can hang an air tube and a pneumatic/electric tool on the hanging members so that the hanging tool can be used to assist the baling operation.

DETAILED DESCRIPTION OF THE PREFERRED EMBODIMENTS

Embodiments of the present invention will now be described, by way of example only, with reference to the accompanying drawings.

Figure 1:
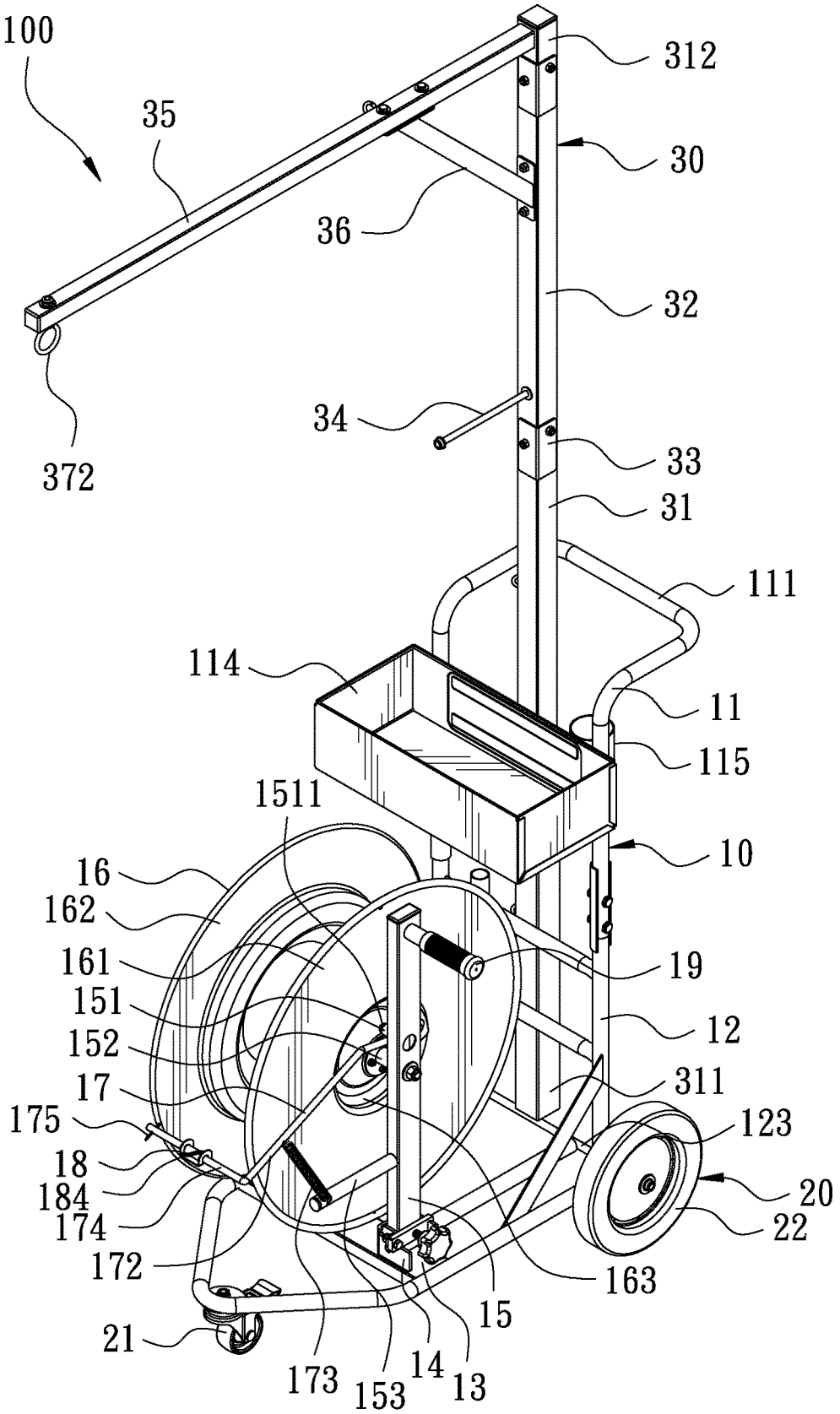
FIG. 1 is a perspective view of the strap dispenser in accordance with a first embodiment of the present invention.

FIG. 1 is a perspective view of a strap dispenser in accordance with a first embodiment of the present invention. The present invention discloses a strap dispenser 100 having a hanging structure. The strap dispenser 100 comprises a base 10, a moving unit 20, and a hanging unit 30.

Figure 2:
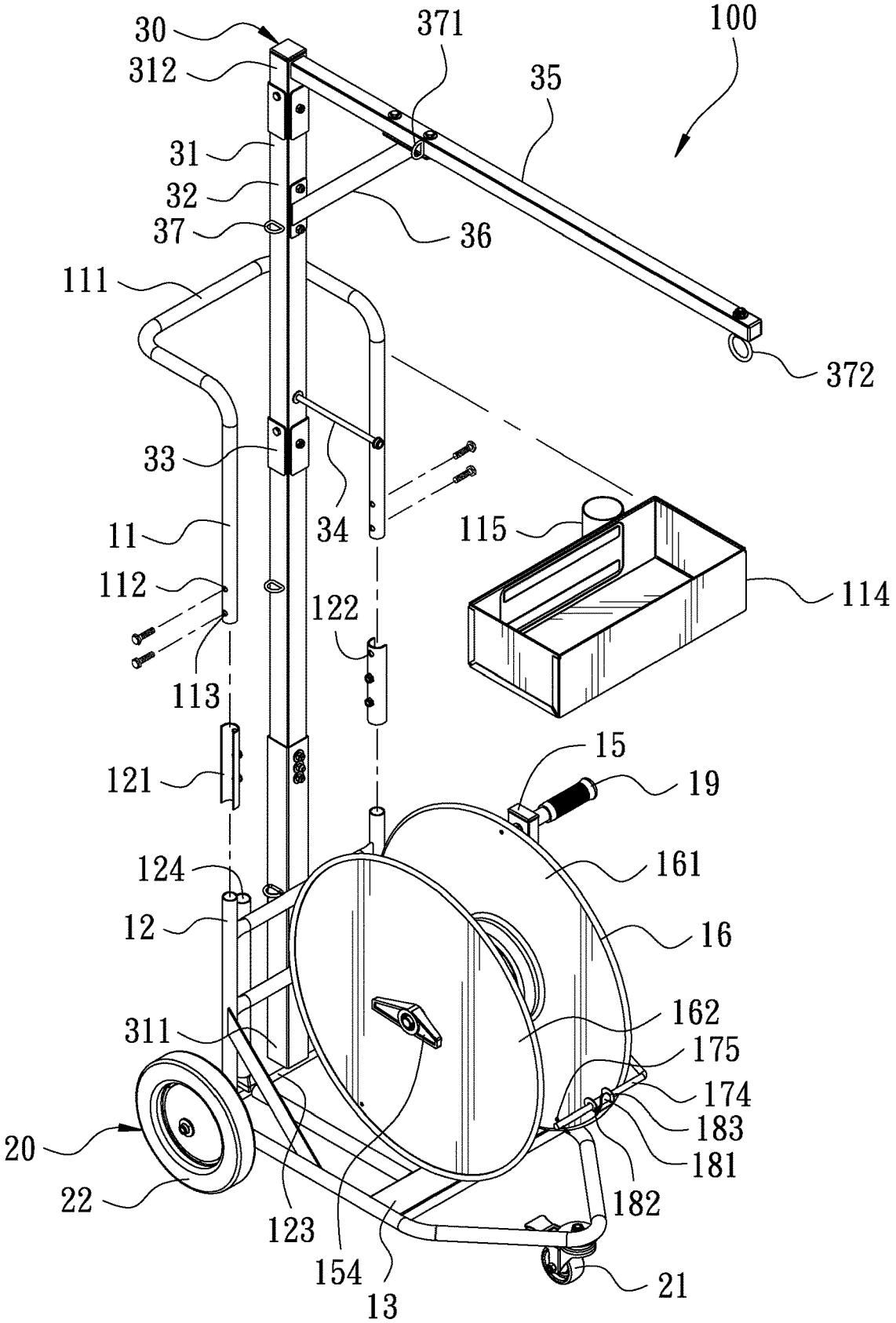
FIG. 2 is a partial exploded view of the strap dispenser in accordance with the first embodiment of the present invention.
Figure 3:
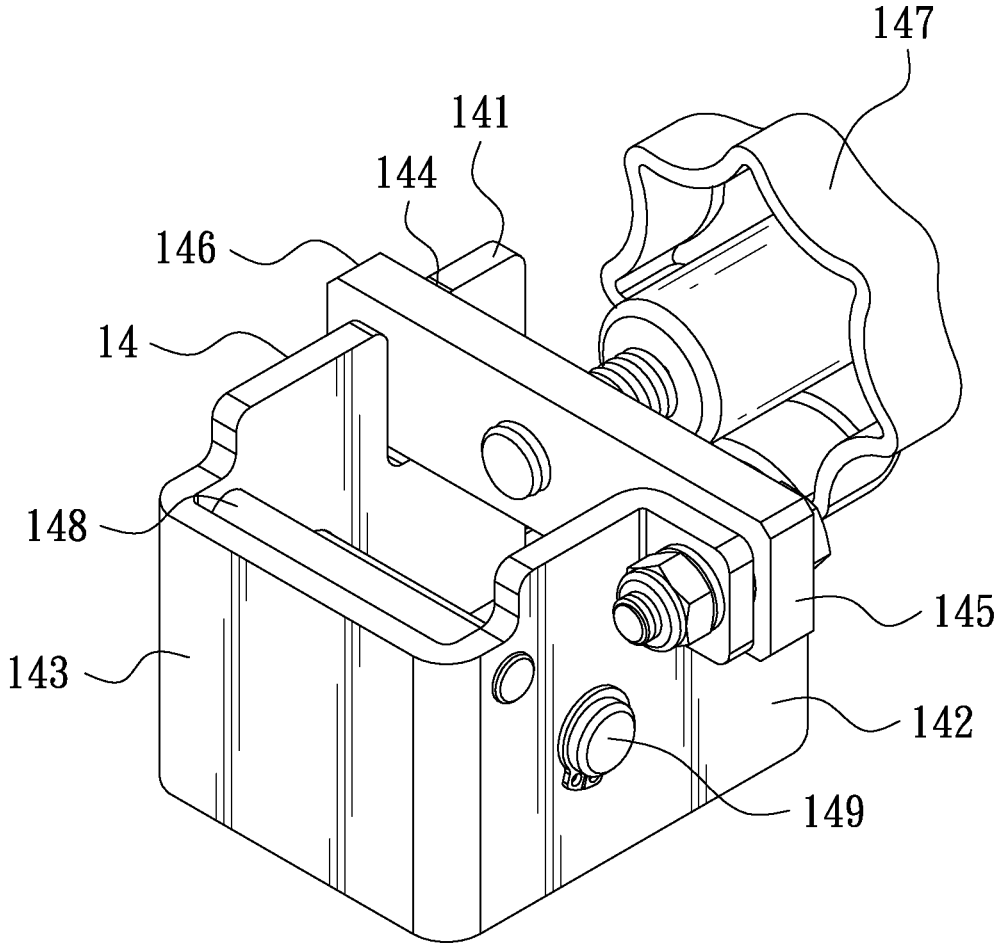
FIG. 3 is a perspective view of the pivot member in accordance with the first embodiment of the present invention.

The base 10 has a first frame 11 and a second frame 12. The first frame 11 has a grip portion 111 and a first coupling member 112. Referring to FIG. 2, the first coupling member 112 has a plurality of first perforations 113. The first frame 11 is provided with a storage box 114 between the grip portion 111 and the first coupling member 112. One side of the storage box 114 is provided with a storage container 115. The second frame 12 is provided with a second coupling member 121 corresponding to the first coupling member 112. The second coupling member 121 is an arc-shaped plate. The second coupling member 121 has a plurality of second perforations 122. The second frame 12 is transversely provided with a wheel shaft 123. The wheel shaft 123 is longitudinally provided with a tube 124. The second frame 12 is transversely provided with a fixing plate 13 parallel to the wheel shaft 123. The fixing plate 13 is provided with a pivot member 14. Referring to FIG. 3, the pivot member 14 has a first pivot plate 141 and a second pivot plate 142 parallel to each other. A connecting plate 143 is connected between the first pivot plate 141 and the second pivot plate 142. The first pivot plate 141 has a groove 144. The second pivot plate 142 is pivotally connected with a stopper 145 corresponding to the groove 144. The stopper 145 is a stopping plate 146. A free end of the stopping plate 146 can be positioned in the groove 144. A middle portion of the stopping plate 146 is provided with an engaging member 147 facing the connecting plate 143. The engaging member 147 is a knob screwed on the stopping plate 146. The pivot member 14 further has a positioning rod 148 passing through the first pivot plate 141 and the second pivot plate 142. The pivot member 14 further has a pivot rod 149 located between the stopper 145 and the positioning rod 148 and passing through the first pivot plate 141 and the second pivot plate 142. The pivot rod 149 is inserted through a strap reel rack 15. A middle portion of the strap reel rack 15 is provided with a limiting rod 151, a shaft 152, and a fixing rod 153. The limiting rod 151 is sleeved with a roller 1511.

Figure 4:
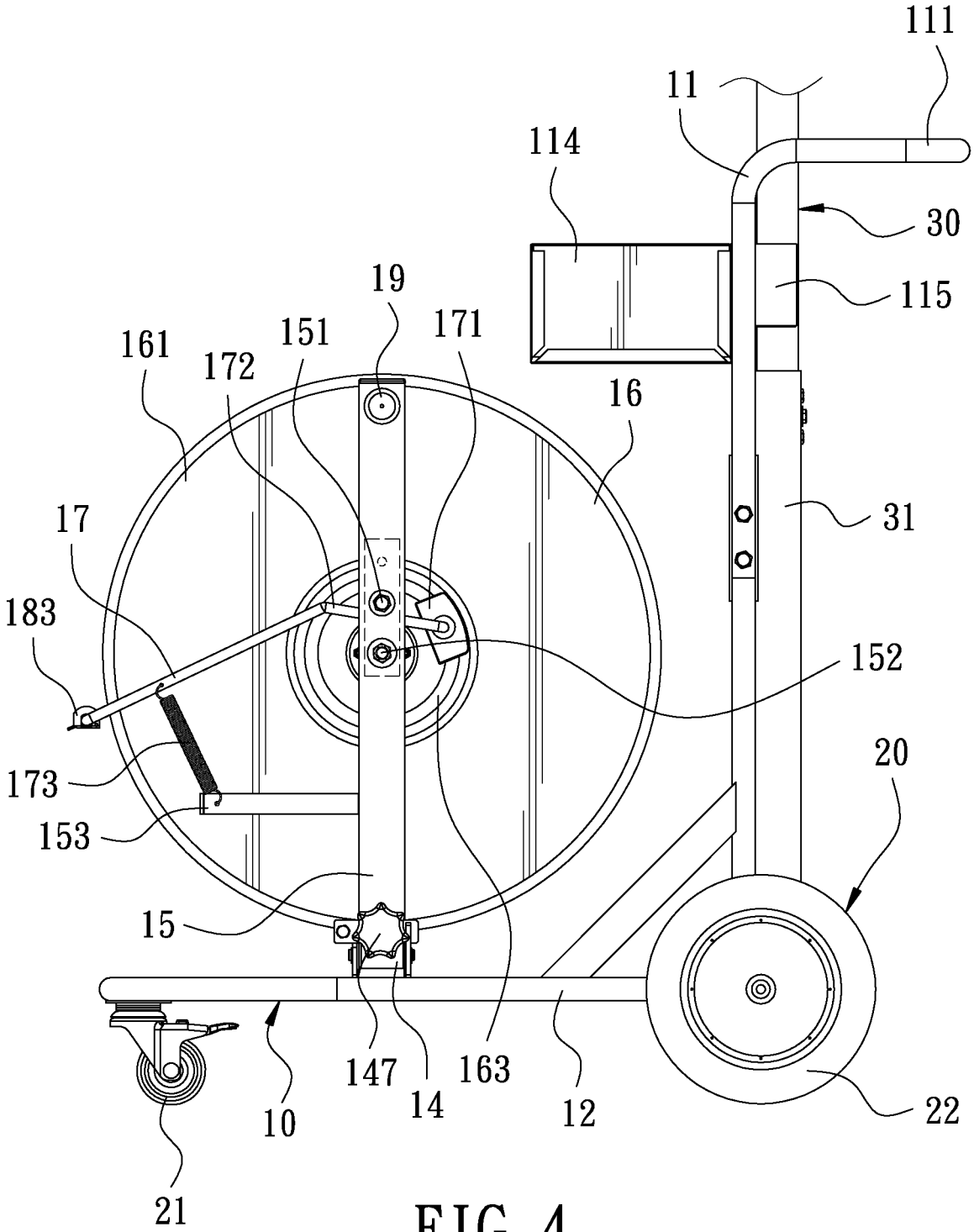
FIG. 4 is a partial side view of the strap dispenser in accordance with the first embodiment of the present invention.

The shaft 152 is located between the limiting rod 151 and the fixing rod 153. The shaft 152 is pivotally connected with a strap reel 16. A free end of the shaft 152 is provided with a fixing member 154. The strap reel 16 has a first disk 161 and a second disk 162 parallel to each other. The first disk 161 is adjacent to the strap reel rack 15. The first disk 161 has a limiting trough 163. A braking device 17 is connected in the limiting trough 163. Please refer to FIG. 4. The braking device 17 includes a braking block 171. The braking block 171 is disposed in the limiting trough 163 of the first disk 161. The braking block 171 may be made of a rubber material with friction. The braking block 171 is connected with a rod 172. The rod 172 is connected with a tension spring 173. A fixed end of the tension spring 173 is connected to the fixing rod 153. A free end of the rod 172 is connected to a braking rod 174. A middle portion of the braking rod 174 is provided with a clamping member 18. The clamping member 18 has a pinch roller 181 and a clamping plate 182. The pinch roller 181 is fitted on the braking rod 174. Two sides of the clamping plate 182 are integrally formed with extension pieces 183. The extension pieces 183 are fitted on the braking rod 174 and located at two sides of the pinch roller 181. A spring 184 is provided between the extension pieces 183. Two ends of the spring 184 are connected to the extension pieces 183 close to the clamping plate 182, respectively. The pinch roller 181 is located between the spring 184 and the clamping plate 182 so that the pinch roller 181 has a prestress in the direction of the clamping plate 182. A pin 175 is insertedly coupled to a free end of the braking rod 174. A free end of the strap reel rack 15 is provided with a support member 19. The support member 19 is a support handle.

The moving unit 20 includes a moving wheel 21 and two fixed wheels 22. The moving wheel 21 is connected to the second frame 12. The fixed wheels 22 are connected to two ends of the wheel shaft 123, respectively. The fixing plate 13 is located between the moving wheel 21 and the fixed wheels 22.

The hanging unit 30 includes a first rack body 31. The first rack body 31 is composed of a plurality of rods 32. At least one connecting member 33 is disposed between the rods 32. A first end 311 of the first rack body 31 is connected to the middle of the wheel shaft 123. A middle portion of the first rack body 31 is provided with a hanging rod 34 perpendicular to the first rack body 31. A second end 312 of the first rack body 31 is connected with a second rack body 35 perpendicular to the first rack body 31. A support rod 36 is connected between the first rack body 31 and the second rack body 35. The first rack body 31 and the second rack body 35 are provided with a plurality of hanging members 37. In this embodiment of the present invention, the plurality of hanging members 37 include a plurality of D-shaped rings 371 disposed on the same sides of the first rack body 31 and the second rack body 35 and an O-shaped fixing ring 372 disposed at a free end of the second rack body 35.

Figure 5:
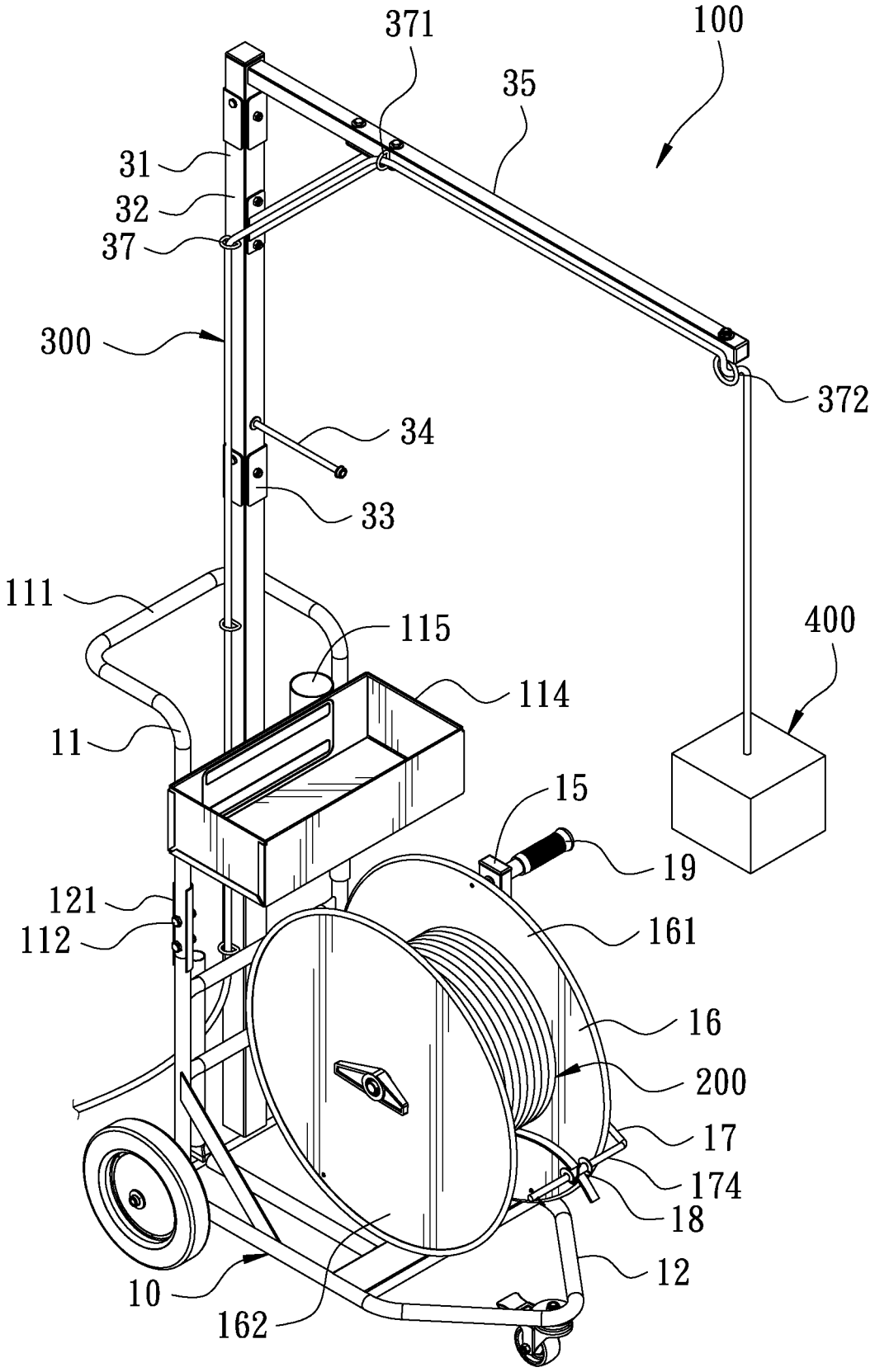
FIG. 5 is a schematic view of the first embodiment of the present invention when in use, showing an air tube and a tool hung on the hanging unit.

FIG. 5 is a schematic view of the first embodiment of the present invention when in use. The first coupling member 112 of the first frame 11 and the second coupling member 121 of the second frame 12 are connected together with a plurality of screws so as to fix the first frame 11 and the second frame 12. The height of the strap dispenser 100 is set, and then the rods 32 are assembled through the connecting member 32 to form the first rack body 31. The first rack body 31 and the second rack body 35 are connected together. Next, the strap reel rack 15 is pivotally connected to the pivot member 14 of the fixing plate 13. The shaft 152 of the strap reel rack 15 passes through the strap reel 16. A strapping roll 200 is mounted between the first disk 161 and the second disk 162. Finally, the braking device 17 is mounted to the first disk 161 to complete the assembly. When the user wants to use the strap dispenser 100, an air tube 300 is inserted through the rings 371 of the hanging unit 30. A tool 400 is hung on the fixing ring 372 of the hanging unit 30. The tool 400 may be a baler, such as a pneumatic baler. The strapping roll 200 is pulled from the clamping member 18. The strap reel 16 is rotated with the pull of the strapping roll 200. The tool 400 is used to tighten or cut the strap so that the user can easily perform the baling operation.

When the user wants to stop using the strap dispenser 100, the braking rod 174 is turned in the direction opposite to the first frame 11. The braking rod 174 is pressed against the limiting rod 151 to generate a lever action, so that the braking block 171 abuts against the limiting trough 163 of the first disk 161 to stop the rotation of the first disk 161, achieving a braking function. After that, the braking device 17 is subjected to the tension spring 173 to return, thereby releasing the braking.

Figure 6:
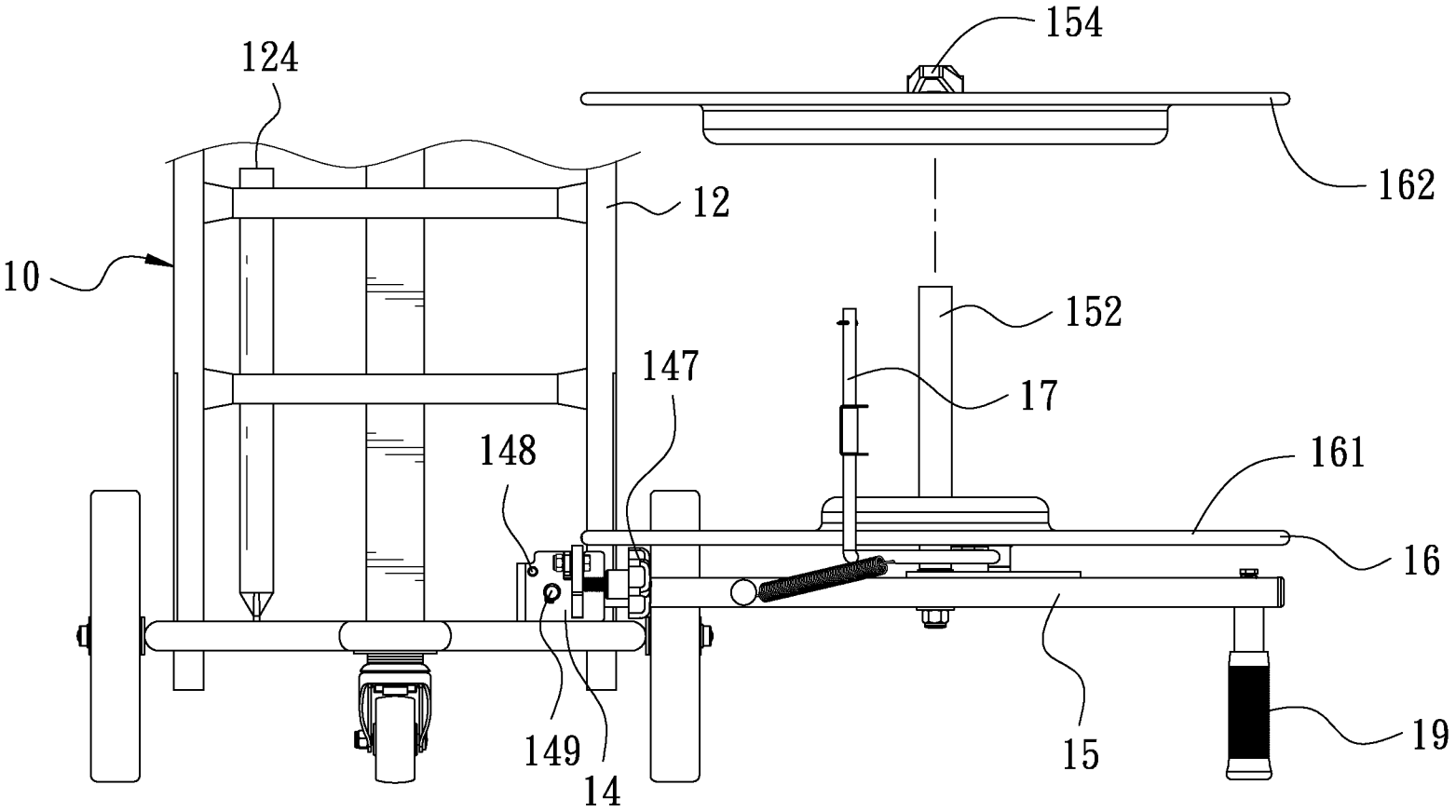
FIG. 6 is a schematic view of the first embodiment of the present invention when in use, showing the replacement of the strapping roll in the strap reel.

When the strapping roll 200 is to be replaced, referring to FIG. 6, the engaging member 147 is loosened to move in the direction opposite to the strap reel rack 15. The free end of the stopper 145 is moved away from the groove 144 to pull the support member 19 so that the strap reel rack 15 is pivoted outwards through the pivot rod 149. At this time, the bottom end of the strap reel rack 15 is positioned to the positioning rod 148. The top end of the strap reel rack 15 leans against a plane through the support member 19 to support the strap reel rack 15, and then the fixing member 154 is rotated and the second disk 162 is taken out to mount a new strapping roll on the shaft 152. After that, the second disk 162 is assembled and fixed by the fixing member 154. The strap reel rack 15 is pivoted back to the original position through the pivot rod 149, the free end of the stopper 145 is moved to the groove 144, and finally the engaging member 147 is tightened and fixed to the strap reel rack 15 to prevent the strap reel rack 15 from overturning so as to complete the replacement of the strapping roll. Therefore, the present invention does not need to turn over the strap dispenser for replacing the strapping roll, thereby saving time and labor.

It is worth mentioning that the storage box 114 may be used for placing the necessary tools. The storage container 115 may be used for placing stationery. The tube 124 may be used for placing a threader. The hanging rod 34 may be used for hanging labels so as to enhance the convenience of using the strap dispenser 100.

It is worth mentioning that the first coupling member 112 of the first frame 11 and the second coupling member 121 of the second frame 12 are connected to each other. The first rack body 31 is composed of the rods 32 connected by the connecting member 32. Therefore, when transported, they can be disassembled to reduce the volume, so as to increase the carrying capacity during transportation and further reduce the transportation cost.

Figure 7:
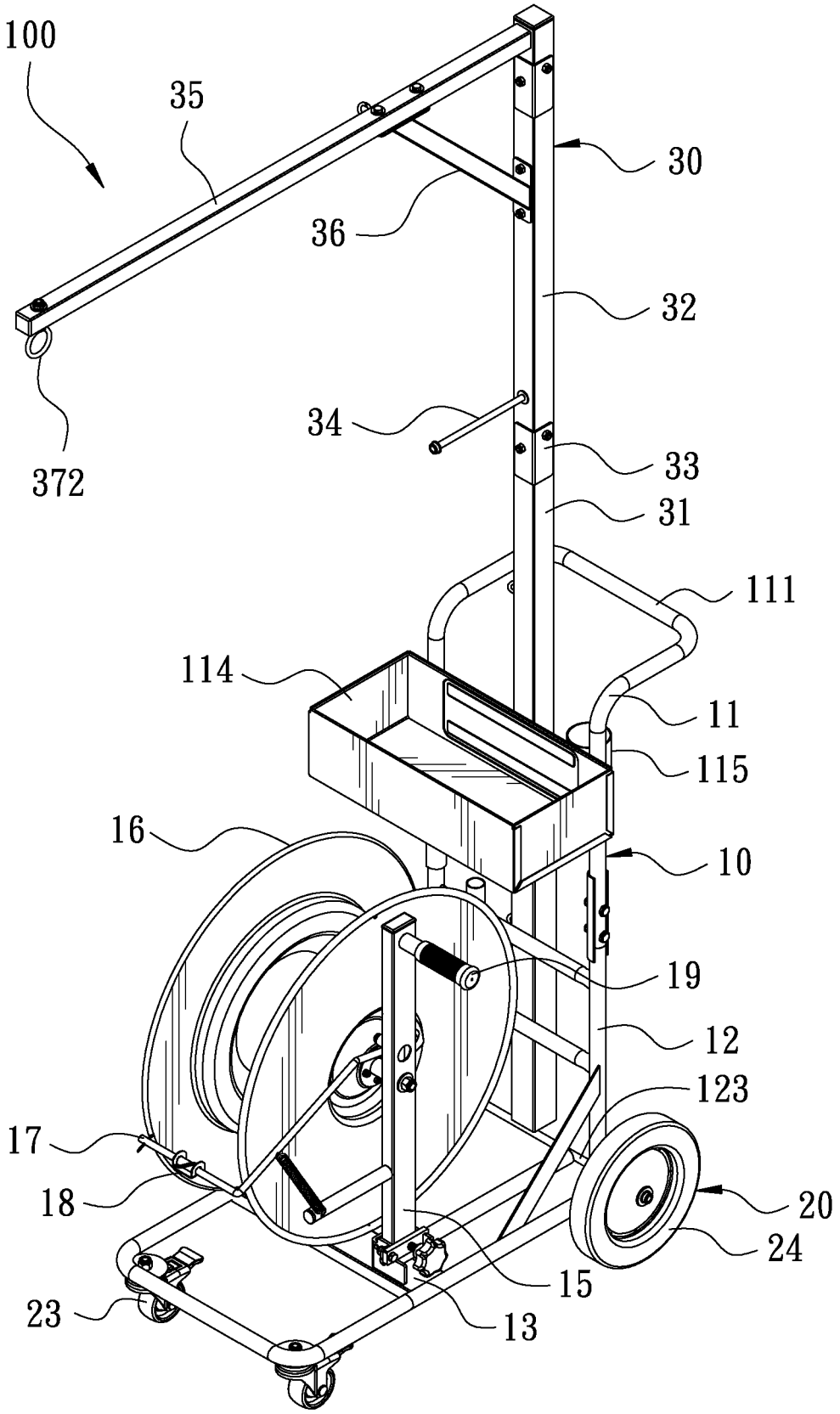
FIG. 7 is a perspective view of the strap dispenser in accordance with a second embodiment of the present invention.

FIG. 7 is a perspective view of a strap dispenser in accordance with a second embodiment of the present invention. The second embodiment is substantially similar to the aforementioned first embodiment with the exceptions described hereinafter. The moving unit 20 includes two moving wheels 23 and two fixed wheels 24. The moving wheels 23 are mounted to the second frame 12. The fixed wheels 24 are disposed at two ends of the wheel shaft 123, respectively. The fixing plate 13 is located between the moving wheels 23 and the fixed wheels 24. In this way, the center of gravity of the strap dispenser 100 is relatively stable, and the strap dispenser 100 can be moved conveniently.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A strap dispenser, comprising:

a base, including a wheel shaft and a fixing plate, the fixing plate being provided with a strap reel rack, a shaft being inserted into and connected to the strap reel rack, the shaft being pivotally connected with a strap reel, the strap reel having a first disk and a second disk parallel to the first disk;

a moving unit, including at least one moving wheel and two fixed wheels, the moving wheel being mounted to the base, the fixed wheels being mounted to two ends of the wheel shaft respectively; and a hanging unit, including a first rack body, a first end of the first rack body being connected to the base, a second end of the first rack body being connected with a second rack body, the first rack body and the second rack body being provided with a plurality of hanging members.

2. The strap dispenser as claimed in claim 1, wherein the base has a first frame and a second frame, the first frame has a first coupling member, the second frame has a second coupling member corresponding to the first coupling member, the second frame is provided with the wheel shaft and the fixing plate, and the moving wheel is mounted to the second frame.

3. The strap dispenser as claimed in claim 2, wherein the first coupling member has a plurality of first perforations, the second coupling member is an arc-shaped plate, and the second coupling member has a plurality of second perforations.

4. The strap dispenser as claimed in claim 2, wherein the first frame has a grip portion, a storage box is provided between the grip portion and the first coupling member, and one side of the storage box is provided with a storage container.

5. The strap dispenser as claimed in claim 1, wherein the fixing plate is provided with a pivot member, the pivot member has a first pivot plate and a second pivot plate parallel to the first pivot plate, a connecting plate is connected between the first pivot plate and the second pivot plate, the first pivot plate has a groove, the second pivot plate is pivotally connected with a stopper corresponding to the groove, a free end of the stopper can be positioned in the groove, a middle portion of the stopper is provided with an engaging member facing the connecting plate, the pivot member has a positioning rod passing through the first pivot plate and the second pivot plate, the pivot member has a pivot rod located between the stopper and the positioning rod and passing through the first pivot plate and the second pivot plate, and the pivot rod is inserted through the strap reel rack.

6. The strap dispenser as claimed in claim 1, wherein the strap reel rack is provided with a limiting rod and a fixing rod, the first disk is adjacent to the strap reel rack, the first disk has a limiting trough, the first disk is connected with a braking device, the braking device includes a braking block, the braking block is disposed in the limiting trough of the first disk, the braking block is connected with a rod, the rod is connected with a tension spring, a fixed end of the tension spring is connected to the fixing rod, a free end of the rod is connected to a braking rod, and a middle portion of the braking rod is provided with a clamping member.

7. The strap dispenser as claimed in claim 6, wherein the clamping member has a pinch roller and a clamping plate, the pinch roller is fitted on the braking rod, two sides of the clamping plate are integrally formed with extension pieces, the extension pieces are fitted on the braking rod and located at two sides of the pinch roller, a spring is provided between the extension pieces, two ends of the spring are connected to the extension pieces close to the clamping plate respectively, and the pinch roller is located between the spring and the clamping plate so that the pinch roller has a prestress in the direction of the clamping plate.

8. The strap dispenser as claimed in claim 6, wherein a pin is inserted into and coupled to a free end of the braking rod.

9. The strap dispenser as claimed in claim 1, wherein a free end of the strap reel rack is provided with a support member, and the support member is a support handle.

10. The strap dispenser as claimed in claim 1, wherein the first end of the first rack body is connected to the wheel shaft, the first rack body is composed of a plurality of rods, at least one connecting member is disposed between the rods, a middle portion of the first rack body is provided with a hanging rod perpendicular to the first rack body, a support rod is connected between the first rack body and the second rack body, and the plurality of hanging members include a plurality of rings disposed on same sides of the first rack body and the second rack body and an O-shaped fixing ring disposed at a free end of the second rack body.

* * * * *